US005427561A

United States Patent [19]

Eichhorn et al.

[11] Patent Number: 5,427,561

[45] Date of Patent: Jun. 27, 1995

[54] BATTERY POWERED TOY TRAIN

[75] Inventors: Hermann Eichhorn; Hermann R. Eichhorn, both of Germany

[73] Assignee: Small World Toys, Culver City, Calif.

[21] Appl. No.: 192,115

[22] Filed: Feb. 3, 1994

[51] Int. Cl.[6] ..... A63H 19/28; A63H 33/26

[52] U.S. Cl. ..... 446/463; 446/447; 446/138; 104/DIG. 1

[58] Field of Search ..... 446/444, 445, 446, 447, 446/462, 463, 465, 467, 470, 471, 137, 138, 129; 104/DIG. 1; 238/75 D, 75 C

[56] References Cited

U.S. PATENT DOCUMENTS

| | | | |
|---|---|---|---|
| 1,708,969 | 4/1929 | Gill et al. | 446/465 X |
| 2,607,157 | 8/1952 | Smith | 213/75 D X |
| 2,645,878 | 7/1953 | Johnson | 446/137 |
| 2,939,245 | 6/1960 | Orel | 446/467 X |
| 3,330,066 | 7/1967 | Crawford | 446/467 X |
| 3,479,765 | 11/1969 | Pankow | 446/137 |
| 3,538,640 | 11/1970 | Hayes et al. | 446/463 X |
| 3,850,310 | 11/1974 | Osthall | 213/75 TC |
| 4,838,828 | 6/1989 | Ohnuma et al. | 446/446 |
| 5,297,982 | 3/1994 | Filoseta | 446/463 X |

FOREIGN PATENT DOCUMENTS

| | | | |
|---|---|---|---|
| 2206499 | 1/1989 | United Kingdom | 446/444 |

*Primary Examiner*—Robert A. Hafer
*Assistant Examiner*—D. Neal Muir
*Attorney, Agent, or Firm*—Small Larkin & Kidde

[57] ABSTRACT

A self-propelled toy train engine for pulling a train of wooden railroad cars over a variety of surfaces including a child safe magnetic coupling for connecting the engine to the railroad cars, high traction drive wheels for being propelled over a variety of surfaces, a gear train which disengages from the drive axle given a predetermined force. The train engine is weighted to provide added traction for propelling the train set over smooth surfaces and a low center of gravity for stabilizing the engine when propelling the train set over rough surfaces such as carpeting.

9 Claims, 6 Drawing Sheets

BATTERY POWERED TOY TRAIN

BACKGROUND OF THE INVENTION

1. Field Of The Invention

The present invention relates to a battery operated train set, a train engine for propelling a train set and, more specifically, to a battery operated train engine for propelling a wooden train set over a plurality of surfaces including wooden train tracks.

2. Description Of The Related Art

Model train sets have brought enjoyment to children and collectors alike for as long as locomotives have been used in commerce. Realistic working train models are available for the collector, while more durable models have been developed for children. The more realistic train models can have intricate edges which may easily break when used by children and generally come with an electrical transformer connected to a wall outlet for electrifying a set of railroad tracks in order to propel a set of trains. Children's model train sets generally incorporate more durable components and lack the electrical transformer for their playtime adventures.

One such child's train set design utilizes durable wooden railroad cars having durable, laminated edges for use with children. These train sets can be manually propelled along almost any play surface by a child. Such trains are also preferably of a size which enables them to be packed and used for play when traveling. However, the child, like the collector, enjoys the look and feel of a self-propelled train set. The problem exists in providing a train engine that can adequately pull a train comprised of railroad cars, preferably wooden. While an engine utilizing a transformer to electrify a set of train tracks could do the job quite well, the transformer requires wall outlet power which limits the location in which the train set can be used and increases the hazards from electrical shock. Battery powered train sets for use with plastic railroad cars typically lack the necessary traction to pull wooden railroad cars, especially over surfaces such as table tops where dust or other traction-reducing particles can further inhibit the train. Thus, the problem exists for providing a self-propelled train engine for propelling a train of wooden railroad cars, or cars having a weight substantially similar to wooden cars.

OBJECT(S) OF THE INVENTION

The primary object of the present invention is to provide a self-propelled toy train engine for propelling a wooden toy train set on a variety of surfaces.

Another object of the present invention is to provide an improved battery powered train engine.

Yet another object of the invention is a train engine having torque and traction sufficient to pull a plurality of wooden railroad cars, with the train engine being movably coupled to the wooden cars in a manner to allow the train to easily glide over overpasses or hills incorporated into the wooden train tracks on which the engine must operate.

SUMMARY OF THE INVENTION

The present invention is a battery powered train set that can be operated on a variety of surfaces including a wooden train track, where the wooden train track includes overpasses requiring the train engine to propel the train set over hills. The train engine generally includes a metal base to aid in traction and stability, with a plastic cover for housing the drive mechanism. The drive mechanism includes a battery operated motor and gear train which provides sufficient torque to pull a set of railroad cars, preferably wooden or of a weight equivalent to wooden cars. Further included in the drive wheels of the train engine are knobbed, rubberized wheels configured to cooperate with the weighted base to provide sufficient traction to allow the engine to pull the train cars along a variety of surfaces.

The train engine and cars are connected by a series of magnetic couplings which are designed to provide flexibility in allowing the train system to maneuver around curves. Further, the coupling mechanism of the train engine pivots the engine with respect to the coupled train set about a latitudinal axis to allow the train to properly hug hilly surfaces, thus preventing the train's wheels from lifting or derailing from the train tracks. The train drive mechanism and coupling provides realistic locomotion of a wooden train set over a variety of surfaces.

BRIEF DESCRIPTION OF THE DRAWINGS

The objects and advantages of the present invention will become more readily apparent to those ordinarily skilled in the art after reviewing the following detailed description and accompanying documents wherein.

DESCRIPTION OF THE PREFERRED EMBODIMENT(S)

Figure 1:
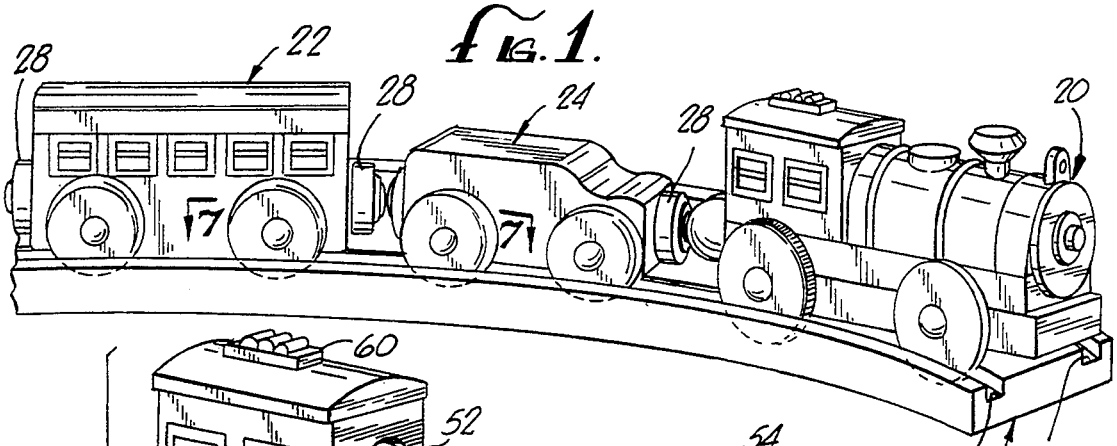
FIG. 1 is a perspective view of a preferred embodiment of the wooden train set of the present invention positioned on a segment of a wooden train track set.

Referring to the drawings more particularly by reference numbers, FIG. 1 shows generally the toy train set of the present invention having a train engine 20 coupled to a plurality of wooden train cars 22 and 24 for use on a play surface such as a wooden train track 26 having parallel gutters 27 to direct the train set. Each of the train cars 22 and 24 includes magnets 28 mounted at opposite ends of the train pieces for magnetically coupling the train cars together.

Figure 2:
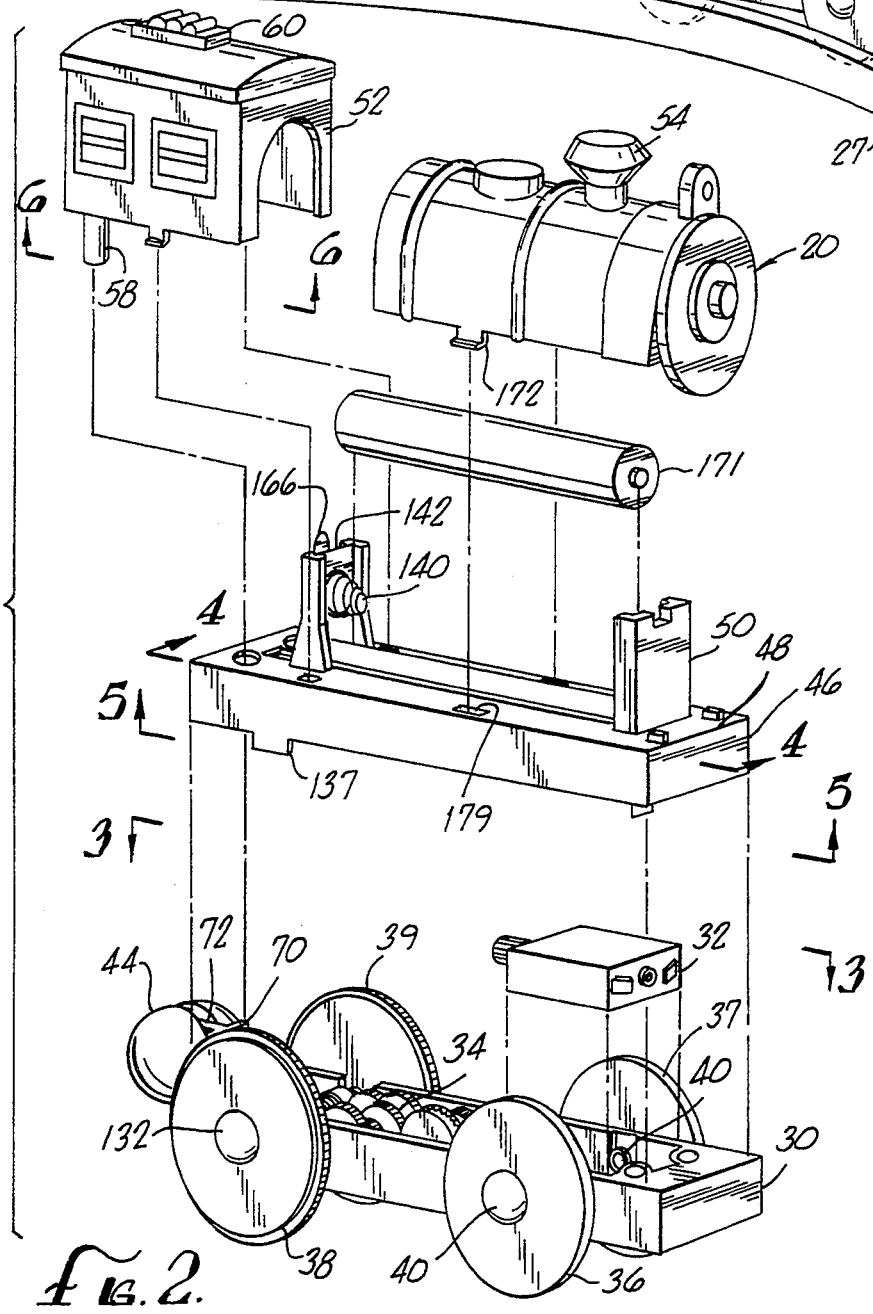
FIG. 2 is an exploded perspective view of the train engine of the present invention.
Figure 3:
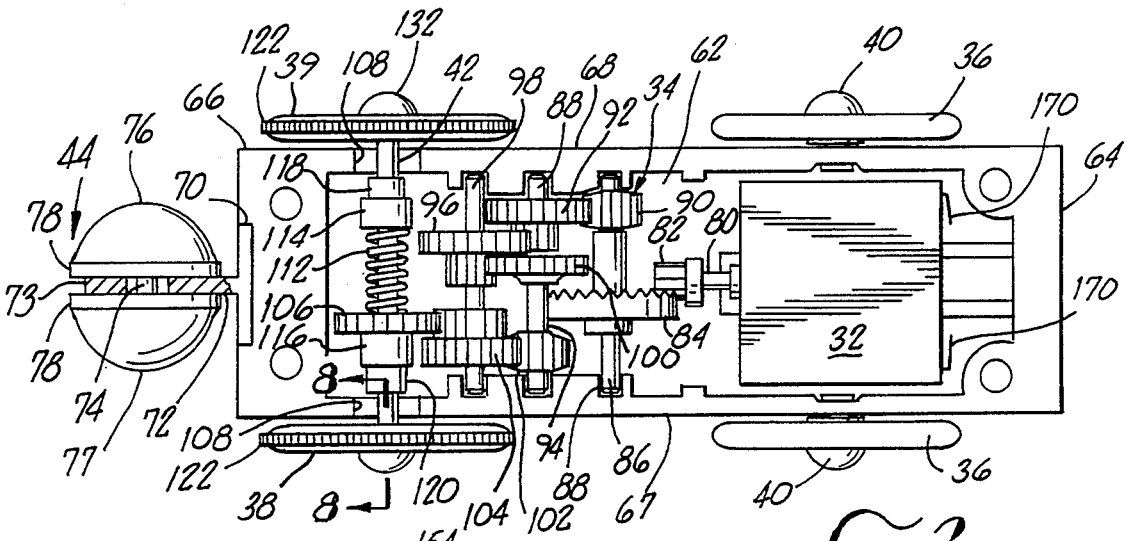
FIG. 3 is a cutaway top view of the train engine of the present invention taken along line 3—3 of FIG. 2.

With reference to FIG. 2 and 3, the train engine 20 of the present invention includes generally a housing base 30 for housing a direct current (DC) drive motor and gear train 34. Coupled to the housing base are a set of four wheels 36–39. A pair of front wheels 36–37 consist of two disc-shaped plastic wheels coupled conventionally to the respective sides of the base by respective rivets 40 through the center of the wheels. The rivets 40 permit free rotation of the wheels about the center point of the wheels. The rear wheels 38–39 are connected to a drive axle 42 (FIG. 3) which in turn engages with the gear train 34. A metallic coupling 44 extends laterally away from the rear of the base.

A base lid 46 mounts over the housing base 30 to secure and enclose the gear train 34 and drive motor 32 within the base housing. The upper surface 48 of the base lid forms a battery holder 50 for holding a conventional 1.5 volt battery, such as a size "AAA" type battery, in the preferred embodiment.

Figure 4:
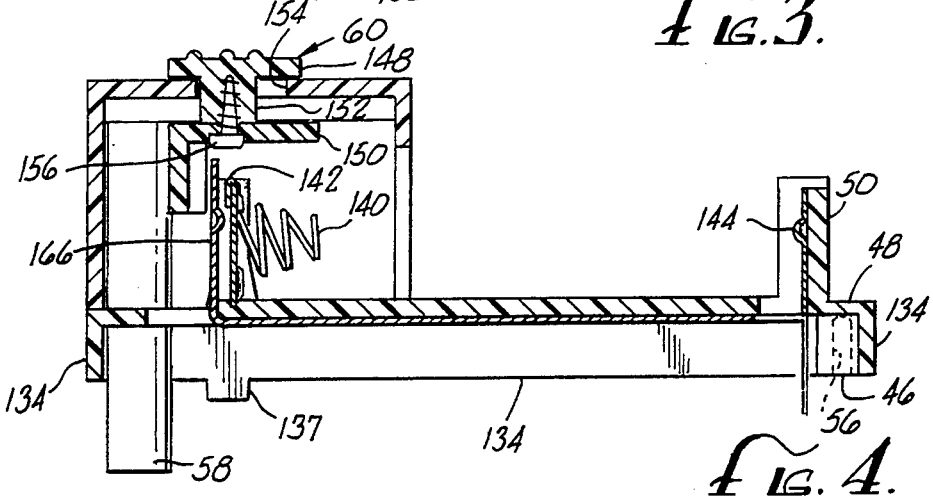
FIG. 4 is a cutaway side view of the train engine of the present invention taken along line 4—4 of FIG. 2.

A two-piece battery cover 52 and 54, having a secured cover 52 and a removable cover 54, overlies the housing lid 48 and completely encloses the battery holder 50. The dimensions and shape of the covers may vary according to the desired train design to be used. In the present embodiment, the covers are shaped to represent a 19th century steam engine with the secured cover 52 formed in a generally rectangular shape, depicting the engineer's cabin, and the removable cover 54 formed in a semicylindrical shape, depicting the steam engine boiler. It should be noted that while the shape and size of the covers may vary, the covers must always enclose the battery, and the removable cover must expose the battery holder sufficiently to permit the exchange of batteries by the user. Screws (not shown) connect the housing lid and housing base at the front corners 56 of the train and screw mounts 58 (FIG. 4) on the secured battery cover 52 extend through the housing lid and housing base in the rear of the train to mount with screws (not shown). A knobbed, slidable switch 60 at the top of the fixed battery cover is slidably connected to the battery cover 52.

With reference to FIG. 3, the housing base is shown having a planar floor 62, a front end wall 64, a rear end wall 66, and two side walls 67 and 68 extending perpendicularly above the floor surface 62, forming a housing cavity. The housing base is preferably cast from a nonmagnetic metal alloy which endows the locomotive with sufficient weight to obtain the necessary traction to pull a series of railroad cars, preferably wooden, and to provide a low center of gravity to maintain stability.

The rear wall 66 includes a central rectangular plate 70 formed above the wall having a laterally formed coupling mount 72 of equal height protruding away from the rear of the housing base and tab slots to secure the drive axle. The coupling mount 72 extends from the center of the plate to a distal end 73 such that the plate and coupling mount 72 form a T-shape in lateral cross-section. A latitudinally positioned coupling axle 74 extends through an aperture through the side of the coupling mount 72 near the distal end 73. A metal ball bearing halved into equal parts 76 and 77 about a longitudinal diameter connects on opposite sides of the axle 74 maintaining the coupling mount 72 in between in a spaced-apart parallel arrangement. The outer radius of the bearing halves form a flat rim surface 78 concentric with the latitudinal axle.

With reference to FIGS. 2 and 3, a direct current (DC) electric motor 32 is mounted proximate the front end wall 64 of the housing and includes a centrally located motor drive shaft 80 having a concentric motor drive pinion 82 that extends outward towards the rear end wall of the housing above and parallel to the planar floor. A side-gear 84, rigidly connected concentrically about a laterally positioned side-gear axle 86 which is movably secured in opposing notches 88 formed in the inner surface of the opposing side walls 67 and 68 of the housing and perpendicular to the motor drive shaft 80, engages the side-gear 84 of the drive motor. A pinion 90, also rigidly connected concentrically about the side-gear axle 86, engages a first movable cogwheel and pinion assembly 92 movably connected concentrically about a first central axle 94 which is parallel to the side-gear axle 86 and movably secured to the side walls in a similar fashion as the cam axle. The pinion of first movable assembly 92 on the central axle engages a second movable cogwheel and pinion assembly 96 movably connected concentrically about a second central axle 98 which is parallel to the first central axle 94 on the opposite side from the cam axle 86. The pinion of the second movable assembly 96 engages a cogwheel 100 rigidly connected concentrically about the first central axle 94. A pinion 102, rigidly connected concentrically about the first central axle 94 in spaced-apart relation with the rigid cogwheel 100, engages a rigid cogwheel and pinion assembly 104 rigidly connected concentrically about the second central axle 98. The pinion of the rigid assembly 104 on the second central axle 98 engages a cogwheel 106 movably connected concentrically about the drive axle 42 positioned in parallel with, but closer to the floor surface than the other axles to adjust the height of the base with respect to the tracks.

Figure 13:
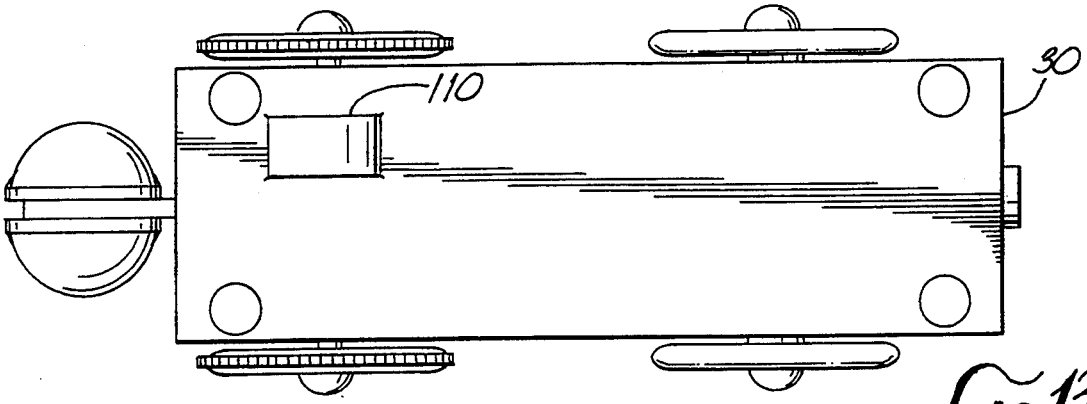
FIG. 13 is a bottom view of the train engine of the present invention.
Figure 14:
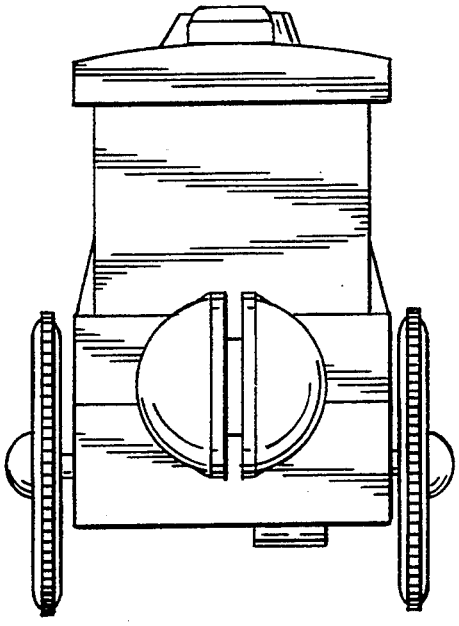
FIG. 14 is a rear end view of the train engine of the present invention.
Figure 15:
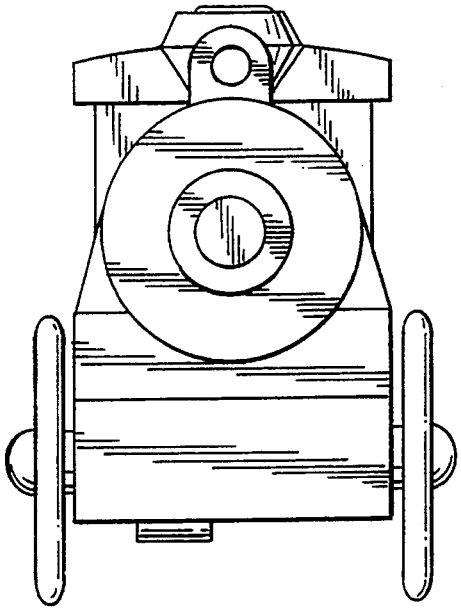
FIG. 15 is a front end view of the train engine of the present invention.
Figure 16:
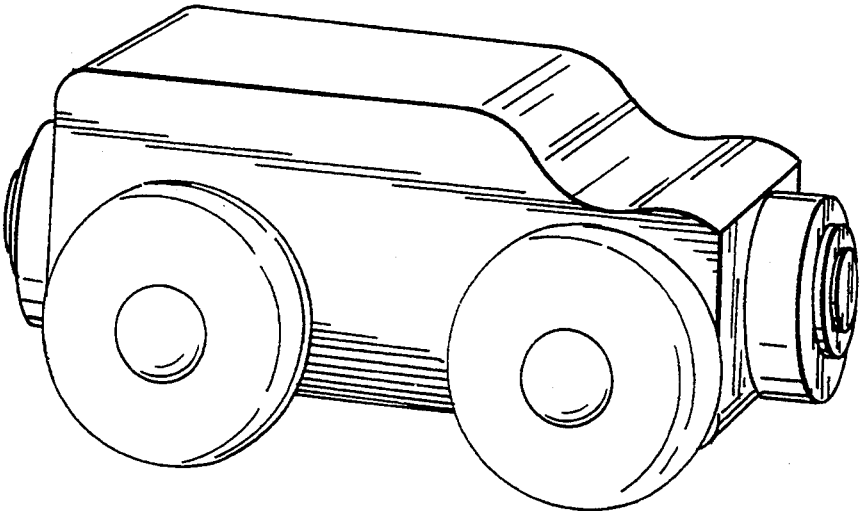
FIG. 16 is a perspective view of a railroad car of the present invention.
Figure 17:
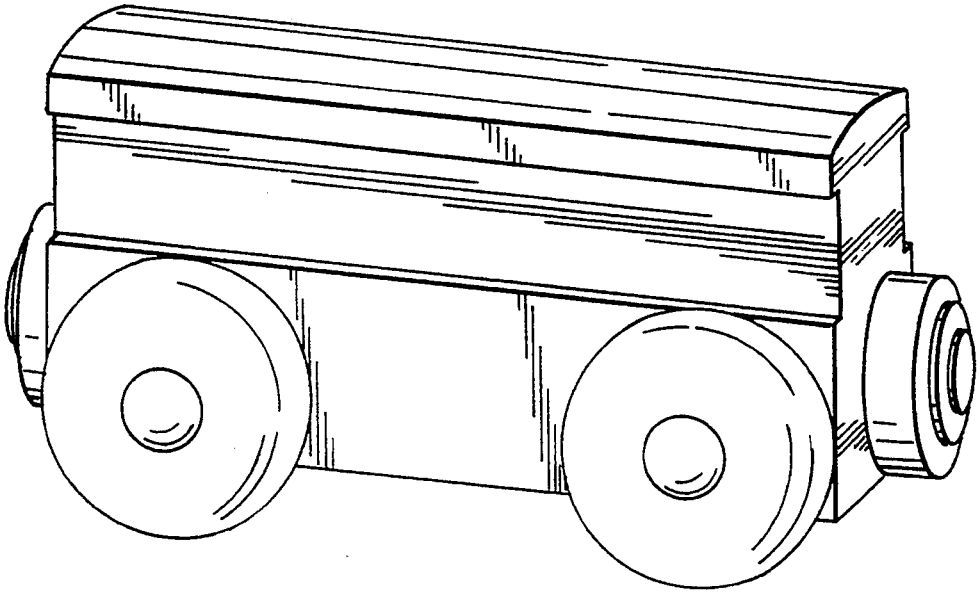
FIG. 17 is a perspective view of a railroad car of the present invention.

The drive axle 42 extends laterally out both sides of the base through notches 108 formed in the opposing side walls. A semi-cylindrical notch 110 (FIG. 13), formed in the floor of the housing, underlies the cogwheel 106 on the drive axle 42 to permit rotation of the cogwheel, which has a radial length greater than the distance between the axle and the base floor. The drive axle also includes a compression-resistant spring 112, movably connected concentrically about the drive axle adjacent to the movable cogwheel 106, and a pair of stops 114 and 116 rigidly connected concentrically about the drive shaft 42 on opposite sides of the movable cogwheel and spring. The stops are rigidly mounted in sufficient proximity to each other so as to cause the spring 112 to compress between the two stops causing a relatively high coefficient of friction to exist between the spring, the cogwheel and stops in which a predetermined amount of force is required to cause the cogwheel to rotate with respect to the drive axle. A pair of movable spacers 118 and 120 center the drive axle within the housing cavity.

The gear train configuration as described provides the translation of high speed rotational movement about a lengthwise axis into high torque rotational movement about a laterally-positioned axle and permits the drive axle to disengage from rotational motion with respect to the gear train when a predetermined force is applied to the drive axle.

Figure 8:
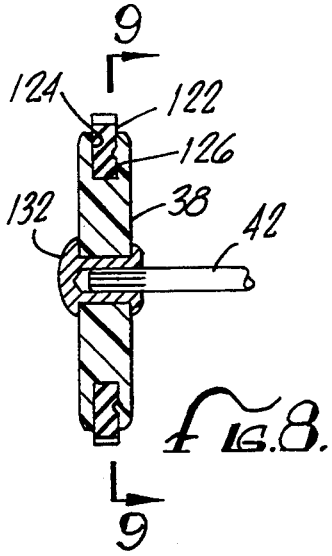
FIG. 8 is a cutaway rear view of a train engine drive wheel taken along line 8—8 of FIG. 3.
Figure 9:
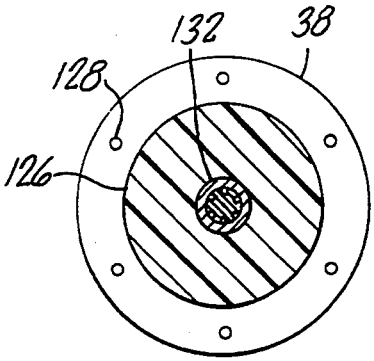
FIG. 9 is a cutaway side view of the train engine drive wheel taken along line 9—9 of FIG. 8.
Figure 10:
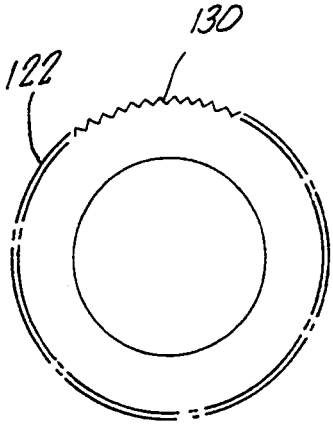
FIG. 10 is a side view of a drive wheel tire.
Figure 11:
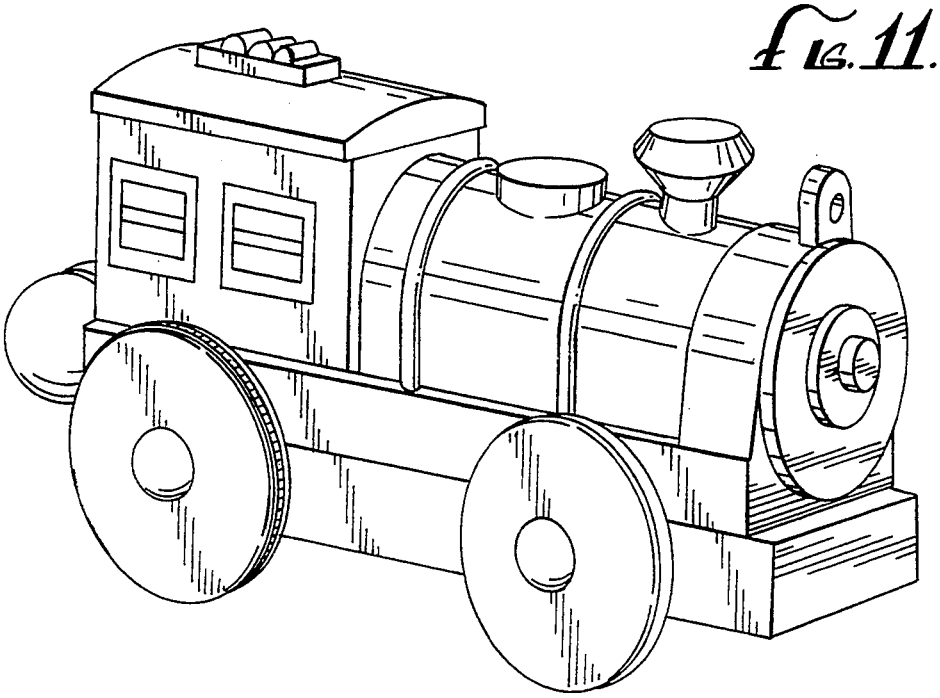
FIG. 11 is a perspective view of the train engine of the present invention.
Figure 12:
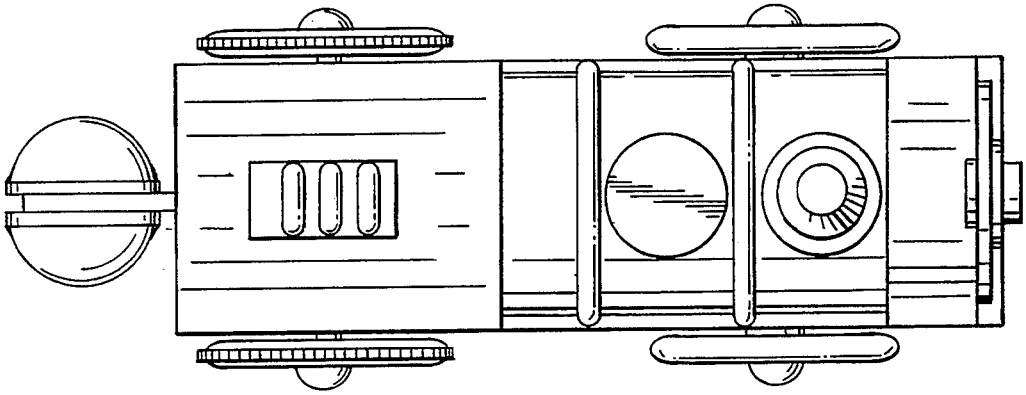
FIG. 12 is a top view of the train engine of the present invention.

As shown in FIGS. 1–3 and 8–10, the rear wheels 38–39 are disk-shaped wheels, preferably of molded plastic, and include respective rubber washers 122 (FIG. 10), each of which is inserted into a grooved slot 124 formed about the rim of the wheels, FIGS. 8–9, to function as a solid rubber tire. With reference to the right side wheel 38, the groove houses the washer concentrically about an inner rim 126. A plurality of radially spaced apart protuberances 128 extend laterally into the grooved slot space from the wheel rim proximate the base. The protuberances 128 serve to further secure the rubber washer 122 in place. The outer rim 130 of the washer, FIG. 10, is formed roughened knobs, or a sawtooth edge, in order to provide additional traction for the drive wheels. Respective rivets 132, having a hollow center, extend through the center of each of the rear wheels and rigidly mount over the respective opposite ends of the drive axle 42.

The base lid 46 includes a planar surface 48 completely covering the housing cavity and four walls perpendicular to the surface projecting toward the housing base including a notch 136 in the rear end wall which matches the central projection formed in the base and tabs 137 extending into the drive axle notch to secure the drive axle. The four walls of the lid increase the height of the cavity and completely enclose the gear train 34 and motor 32 within the base cavity. Also projecting downward perpendicularly to the surface are a pair of motor braces or motor mounts 13 for restraining the DC electric motor 32. The lid is preferably made of plastic or other lightweight material.

Formed on the upper surface of the lid is a battery holder 50 formed in a conventional manner for supporting a conventional 1.5 volt, size "AAA" battery having a spring 140 biased negative terminal lead 142 to hold the battery between the positive 144 and negative 142 leads of the holder.

Figure 6:
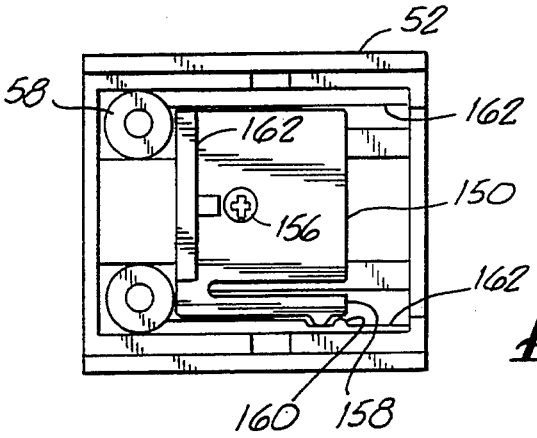
FIG. 6 is a bottom view of the train engine of the present invention taken along line 6—6 of FIG. 2.

The positive terminal lead 144 extends perpendicularly to the lid through an aperture and terminates at a free end 146 beneath the underside of the lid surface. The negative battery terminal lead connects in circuit with an on/off switch 60. The switch may be of conventional type which can be mounted within the battery cover. In the preferred embodiment (FIG. 4), a slide switch formed by a pair of parallel plastic plates 148 and 150 are connected on opposite sides of the battery cover lid and a spacer 152 connects the plates through a lengthwise slot 154 by means of a screw 157. The upper plate 148 is preferably designed to blend in with the train design and provides a knobbed surface for manually sliding the switch along the slot. The lower plate includes a J-hook biased arm 158 (FIG. 6) in parallel with the slot for distinguishing between "on" and "off" positions when the arm slides across a knob 160 along a track 162 on the battery cover underside surface. A contact leg 104 formed in the lower plate having a T-shape in cross-section, extends perpendicularly to the lower plate and when brought into the "on" switch position pushes a motor negative terminal lead 166 biased in the "off" position into contact with the negative terminal end 142 of the battery holder. The J-hook arm 158 and knob 160 restrain the resistive force of the terminal lead 166 from returning to the "off" position.

Figure 5:
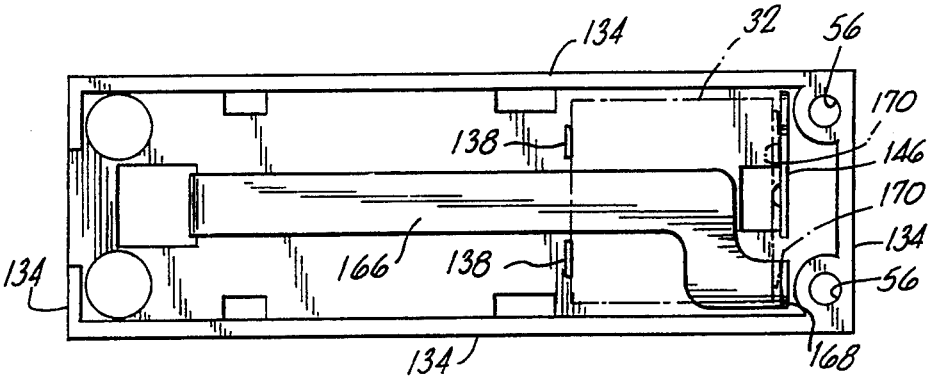
FIG. 5 is a bottom view of the train engine of the present invention taken along line 5—5 of FIG. 2.

The negative motor lead 166 extends through a slot in the lid and along the length of underside surface of the lid and alongside the positive lead terminating in a free end 168 positioned perpendicularly to underside surface of the lid. The free ends of the two leads form a pair of planar surfaces in parallel with the motor braces. The DC electric motor is mounted on the underside of the base lid and connects electrically through metal biased tabs 170 (FIGS. 3 and 5) extending at the opposite end from the shaft which electrically connect with the free ends of the respective terminal leads 146 and 168.

Powered by a 1.5 volt battery 171, the DC motor 32 must be able to rotate the drive shaft sufficiently to generate sufficient torque in the drive axle to pull a train of wooden railroad cars. A preferred motor of this type is Model No. 801, manufactured by Echo Toys of Kowloon, Hong Kong.

The removable portion 54 of the battery cover housing is maintained by two locking tabs 172 which extend laterally down from the cabin area and J-hook knobs located at the lower ends which connect through matching apertures 174 in the lid. This cabin may be snapped into place and is secured by the J-hook knobs and may be accessed by the user compressing the sides of the removable cover thereby releasing the J-hook tabs in order to exchange the batteries.

Figure 7:
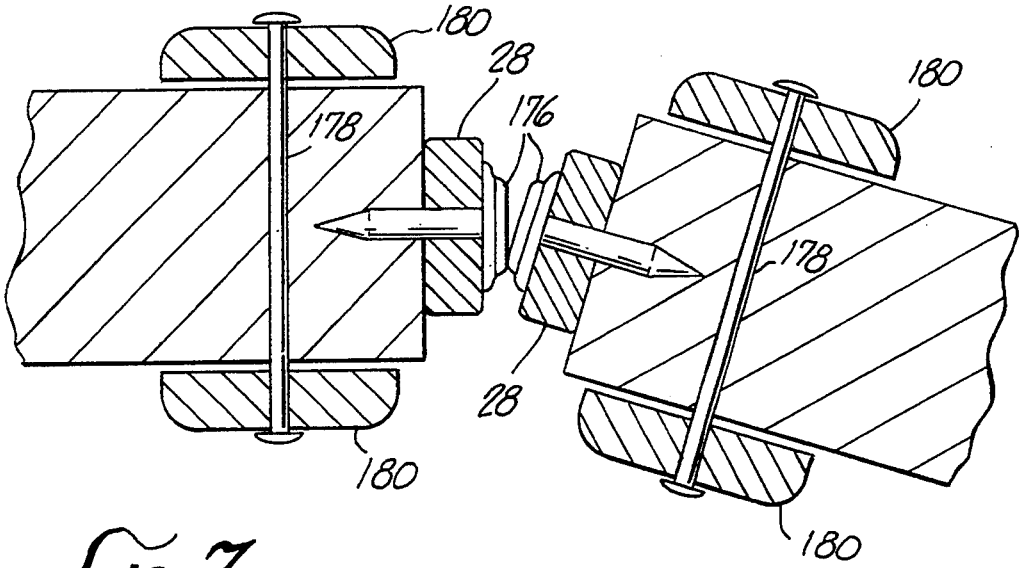
FIG. 7 is a cutaway top view of the toy train set of the present invention taken along line 7—7 of FIG. 1.

Referring now to FIGS. 1 and 7, the wooden railroad cars which are pulled by the engine are produced from wooden blocks. The wooden blocks may be formed into any shapes, although notably, as shown in FIG. 1, a passenger compartment 22 comprising a rectangular railroad car having a curved, arcuate shaped roof and a plurality of passenger windows carved or painted onto the side of the wooden block, and a coal car 24 formed from a rectangular wooden block having a two-tiered sloping roof, are provided in the preferred embodiment.

Magnets 28 mounted by metal nails 176 having a tapered flat surface head are secured at opposite lengthwise ends of the railroad cars for coupling the cars together in a train of cars. Mounted laterally alongside the railroad cars by respective axles 178, two pair of opposing button shaped wheels 180 are rotatably mounted alongside the cars. The magnets 28 on opposite ends of the railroad cars are aligned in their polar arrangement such that corresponding magnets on the respective cars when magnetically coupled together are aligned such that when the cars are coupled together they form a uniform magnetic field. It should be noted that the ball bearing coupling on the engine may be magnetically coupled to any of the magnets on the cars. This permits the engine to connect to either end of any railroad car regardless of the magnet's polar alignment. The metal ball bearing may be able to rotate longitudinally about the latitudinal axis in order to freely move the engine with respect to the railroad cars when being propelled over hills.

Operation

In operation, the wooden railroad cars 22 and 24 and the engine 20 are positioned either on a wooden or plastic track, or on some other suitable play surface such as low-cut carpeting or glass table tops. The railroad cars are magnetically coupled together with the train engine being positioned at one end of the train. The user will then selectively switch the activation switch 60 located on the roof of the cabin compartment drawing the motor lead 166 into contact with the negative terminal of the battery holder. Once the circuit has been completed, the electric motor 32 will be activated, causing the cam shaft 80 of the electric motor to rotate the gear train 34. The gear train 34 translates the high-speed rotational energy of the electric motor into low-speed, high torque rotational energy against the gear located on the drive axle 42. The knobbed rubber drive wheels 38–39 allow the engine to grip the wooden track even when dust is present on the tracks. The weighted base 30 provides sufficient traction to allow the train engine to propel the railroad cars and provides a low center of gravity for stability on surfaces such as carpeting. The friction spring 112 causes the gear 106 to engage with the drive axle 42 of the wheels, thereby causing the wheels to rotate propelling the toy train engine and railroad cars. While in operation should the child pick up the train engine and play with the drive wheels, the force from a child gripping the wheels will over come the coefficient of friction from the spring 112 thus disengaging the gear train 34 from the drive axle. It should be noted that should the battery be removed or deenergized, the train set may be used by manually pushing the engine over a surface once sufficient force is applied to disengage the drive axle from the gear train. The ball bearing coupling located on the rear portion of the train rotates about a latitudinal axis to allow the train engine and railroad cars to pivot about the ball bearing axle, thus adjusting the angular displacement of the train engine with respect to the railroad cars. This rotation maintains the wheels of the train engine and the wheels of the connecting railroad car on the surface when travelling over hills. The ball bearing coupling provides stability for the train engine to overcome the hill. Thus, the present invention provides a suitable train engine mechanism in order to drive a wooden train set over wooden train tracks, or other surface providing the necessary traction in order to overcome overpass hills and to allow the train engine to function even when dust or other traction-reducing objects come into contact with the wheels of the train engine. The drive wheels are designed in order to stop rotation should the user interfere with their operation and permits manual use of the train engine.

While certain exemplary embodiments have been described and shown in the accompanying drawings and specification, it is to be understood that such embodiments are merely illustrative of, and not restrictive, on the broad invention, and that this invention should not be limited to the specific constructions and arrangements shown and described, since various other modifications may occur to those ordinarily skilled in the art.

What is claimed is:

1. A self-propelled toy train engine for propelling wooden railroad cars over a plurality of surfaces, said engine comprising:

a base including a floor, two end walls and two side walls forming a base cavity;

a base lid connected above said base for enclosing said cavity;

a plurality of wheels rotatably connecting to said side walls for movably supporting the base above the plurality of surfaces;

means for rotatably connecting said wheels to said side walls;

drive means connected to at least two of said wheel connection means and housed in said base cavity for rotating said respective wheels;

a coupling mount rigidly affixed to said base and extending perpendicularly away from one of said end walls; and ball means for movably coupling said engine to said railroad cars rotatably connected to said coupling mount said ball means being two magnetically attractive hemispheres linked together through said coupling mount, one hemisphere on each side of said coupling mount.

2. The engine of claim 1 wherein said coupling means include a metallic contact for magnetically coupling with magnets.

3. The engine of claim 1 wherein said drive means includes a electric drive motor and power connection leads for connecting an electric power source to said drive motor, a drive axle connected to at least two of said wheel connection means on opposing side walls, and a gear train connected to said drive motor and said drive axle whereby said wheels connected to said drive axle rotate in response to actuation of said drive motor.

4. The engine of claim 3 wherein said gear train includes means for disengaging said gear train from said drive axle in response to a predetermined force.

5. The engine of claim 1 wherein said wheels connected to said drive means include grooves about said rims, rubber tires housed within said groove and protuberances projecting from said wheel in said groove and connecting said tire for gripping said tire within said groove.

6. The engine of claim 5 wherein said tires include a rim having a saw-toothed edge protruding out of said wheel groove, for increasing the traction of said engine upon the plurality of surfaces whereby said saw-toothed edged rim tires provide traction to enable said drive means to propel said engine over surfaces having traction reducing particles such as saw dust.

7. A self-propelled toy train engine for pulling wooden train cars over a plurality of surfaces, said engine comprising:

a rectangular base having a planar floor, a front end wail, a rear end wail, and two side wails forming a propulsion cavity, wheel coupling points formed on the side wails and a railroad car coupling mount formed on the rear end wail;

a magnetically attracted metal railroad car coupling for connecting railroad cars to said train engine including respective halves of a metal ball bearing, a coupling axle rotatably mounted to said coupling mount and connected at opposite ends to said respective ball bearing halves, whereby said bail bearing halves being magnetically coupled to a railroad car rotate about said axle to adjust the angle of displacement between the railroad car and said train engine;

a housing lid, forming a generally rectangular horizontal surface configured to enclose the propulsion cavity, having a battery holder formed in an upper surface of said lid, and motor mounts and battery terminal leads extending perpendicularly away from the lid toward said base housing;

a pair of front end wheels rotatably mounted by rivets at wheel coupling points on respective opposite sides of said base proximate the front end wall;

a drive motor, positioned in the propulsion cavity and in contact with said motor mounts, having a centrally located rotatable drive shaft and a pair of motor leads electrically connected with said battery terminal leads, said drive shaft having a concentric gear rigidly mounted thereon extending away from said drive motor and said front end such that the position of the axis formed by the drive shaft is aligned with a central axis of said housing running from the front end to the rear end;

a drive axle positioned proximate to the rear end of the housing and coupled to wheel coupling points proximate the rear end wall on opposing side walls such that opposite ends of said drive axle extend through the propulsion cavity and out of respective opposing side walls, a pair of drive wheels rigidly connect to opposite ends of the drive axle, a drive gear located within the propulsion cavity couples concentrically about the drive shaft, a friction spring couples concentrically about the drive shaft proximate the drive gear, a pair of stops rigidly connect concentrically about the drive shaft on opposite ends of the drive gear and spring for compressing said spring to frictionally maintain said drive gear and spring against said stops whereby a predetermined force applied by said drive axle overcomes the bias of said spring to permit said drive axle to rotate with respect to said drive gear; and a gear train engages said drive shaft and said drive gear for rotating said drive gear in response to rotation of said drive shaft, whereby a battery connected within said battery holder energizes said motor causing said drive shaft to rotate; said gear train, responsive to the rotation of said drive shaft, rotates said drive gear and said drive axle thereby propelling said train.

8. The engine of claim 7 wherein each of said drive wheels includes a wheel having a rim, a groove formed in the rim of said disk, means for connecting said wheel to said axle, a tire disposed about said grooved rim, means for maintaining said tire on said rim, said tire including a knobbed outer rim for gripping said plurality of surfaces.

9. The engine of claim 7 wherein said base is weighted for providing traction on smooth surfaces.

* * * * *